United States Patent [19]

Brumbaugh et al.

[11] Patent Number: 4,857,114

[45] Date of Patent: Aug. 15, 1989

[54] FLOOR POLISH REMOVER

[75] Inventors: Ernest Brumbaugh; Roy M. Taylor, Jr., both of Rockford, Mich.

[73] Assignee: Amway Corporation, Ada, Mich.

[21] Appl. No.: 37,473

[22] Filed: Apr. 13, 1987

[51] Int. Cl.[4] ..... C11D 3/075; C11D 3/30

[52] U.S. Cl. ..... 134/42; 252/525; 252/529; 252/156; 252/524; 252/DIG. 14

[58] Field of Search ..... 252/156, 173, 525, 529, 252/544, 548, 174.21, 174.22, DIG. 14, 153, 524; 134/42

[56] References Cited

U.S. PATENT DOCUMENTS

| | | | |
|---|---|---|---|
| 3,168,478 | 2/1965 | Stefcik | 252/135 |
| 3,553,143 | 1/1971 | Bauer | 252/156 |
| 3,956,197 | 5/1976 | Schoenholz et al. | 252/526 |
| 3,970,595 | 7/1976 | Ginn et al. | 252/545 |
| 4,174,304 | 11/1979 | Flanagan | 252/524 |
| 4,348,292 | 9/1982 | Ginn | 252/90 |
| 4,425,266 | 1/1984 | Beck et al. | 252/117 |
| 4,486,329 | 12/1984 | Ellis et al. | 252/117 |
| 4,683,008 | 7/1987 | Betts | 134/27 |

FOREIGN PATENT DOCUMENTS 1479611 7/1977 United Kingdom .

*Primary Examiner*—Prince E. Willis

*Attorney, Agent, or Firm*—Price, Heneveld, Cooper, DeWitt & Litton

[57] ABSTRACT

Floor polish remover compositions containing a low molecular weight nonionic surfactant, an alkaline builder, a hydrotrope and an amine. In one aspect, the floor polish remover composition of the present invention includes demineralized water such that the composition is in liquid form. The low molecular weight nonionic surfactants used in the present invention are the condensation products of low molecular weight alcohols having an average of from about 5 to about 11 carbon atoms with an alkylene oxide. A method of making the floor polish remover compositions of the present invention and their methods of use are also provided.

10 Claims, No Drawings

FLOOR POLISH REMOVER

FIELD OF THE INVENTION

The present invention relates generally to compositions which are applied to floor surfaces and, more specifically, to compositions which are suitable for use in removing layers of dull, aged floor polish from floor surfaces.

BACKGROUND OF THE INVENTION

Numerous brands of floor polish, also commonly referred to as floor waxes, are available commercially. The ingredients and the relative proportions of ingredients vary widely among the brands, but most include acrylic copolymers which are chemically crosslinked, typically with zinc. Most floor polishes also contain natural and/or synthetic waxes, natural and/or synthetic resins and other performance ingredients such as but not limited to coalescing agents, plasticizers, surface active agents, and defoamers. Although commercial floor polishes are generally sold as liquids, dry compositions are also known. In use, floor polishes are applied to floor surfaces which may be vinyl, and vinyl composition tile, linoleum, ceramic tile, sealed wood, or one of the many other hard or resilient flooring materials currently available. When dry, the layer of floor polish is often buffed to yield a desirable shine to the flooring. The shiny acrylic or wax layer provides a barrier to protect the flooring material from spills and the like and resists scuffing.

However, after repeated contact with dirt and other soils such as that deposited by pedestrian traffic, and as a result of repeated cleaning with hard surface cleaners, an originally shiny layer of polish loses its gloss and clarity, becoming dull, scratched, sometimes yellowed and soiled with ground-in dirt. Hence, after extended periods it becomes necessary to remove the aged layer of polish so that it can be replaced with a new layer. The removal of floor polish from floor surfaces has in the past generally been achieved through the use of strong solvents such as glycol ethers contained in fully-built floor polish removers. These conventional floor polish removers also typically contain ammonia. It was previously believed that these strong solvents and ammonia, or very high pH, were necessary to substantially remove the aged layer of polish due to its inherent ability to resist degradation. In particular, floor polishes which include acrylic polymers having zinc crosslinkages are formulated to resist detergents and are thus extremely difficult to remove. Polish removers containing solvents and ammonia disrupt the zinc crosslinkage such that the ammonia forms coordination compounds with the zinc and the solvents soften the polymers. Other ingredients then remove the disrupted acrylic polymers.

For a number of reasons, consumer preference for floor polish removers has turned away from the use of strong solvents and ammonia. In particular, the strong ammoniacal odor associated with ammonia-containing compositions are undesirable. However, performance, convenience of use, and economy are still significant concerns to the consumer.

Therefore, it would be desirable to provide a floor polish remover which conveniently and effectively removes a layer of floor polish and which does not contain ammonia or strong solvents such as glycol ethers both of which have undesirable strong odors. It would also be desirable to provide such a floor polish remover which is particularly effective in removing floor polishes containing acrylic polymers. It would further be desirable to provide a convenient, economical method of manufacturing such a floor polish and the simple method of using such a polish. The present invention achieves these goals.

SUMMARY OF THE INVENTION

It has now been discovered that a high-performance floor polish remover composition may be formulated without the use of strong solvents such as glycol ethers and without ammonia. In accordance with the present invention there is provided a floor polish remover composition which, in liquid form, comprises a low molecular weight nonionic surfactant, an alkalinity builder, a hydrotrope, an amine, and demineralized water. In another aspect, by eliminating the water component from the present invention, a dry floor polish remover is provided. The inventive floor polish remover composition is exceptionally effective in removing dull, aged floor polish from floor surfaces which is known to be particularly difficult to remove. Hence, the present invention provides a floor polish remover which does not contain undesirable glycol ether solvents and which does not give off unwanted ammonia vapors.

The nonionic surfactant component of the present invention comprises the condensation products of aliphatic alcohols having an average of from about 5 to about 11 carbon atoms condensed with from about 2 to about 8 moles of an alkylene oxide per mole of aliphatic alcohol. The specific aliphatic alcohols which are used to obtain the 5 to 11 carbon atom average are those aliphatic alcohols which have a carbon atom chain of from about 4 carbon atoms to about 20 carbon atoms. In the liquid embodiment of the present invention, a nonionic surfactant comprises from about 0.1 percent to about 30.0 percent by weight of the floor polish remover composition; an alkalinity builder comprises from about 0.1 percent to about 30.0 percent by weight of the composition; a hydrotrope comprises up to about 30.0 percent by weight of the composition; an amine comprises from about 0.1 percent to about 30.0 percent by weight of the composition; and substantially demineralized or "soft" water comprises from about 1.0 percent to about 99.0 percent by weight of the composition. It is to be understood that mixtures of surfactants, alkalinity builders, hydrotropes, and amines of the categories described herein may be used in the present invention. That is, it is not necessary that the novel composition contain only a single kind of nonionic surfactant, alkalinity builder, hydrotrope, and amine.

In the embodiment of the present invention which is a dry mixture, a nonionic surfactant comprises from about 1 percent to about 30 percent by weight of the floor polish remover composition; an alkalinity builder comprises from about 1 percent to about 97 percent by weight of the composition; and, an amine comprises from about 1 percent to about 30 by weight of the composition. Again, it is not necessary that the dry composition contain only a single type of nonionic surfactant, alkalinity builder, hydrotrope, and amine.

By using ethoxylated nonionic surfactants in the present invention which have a relatively low average molecular weight, unexpected superior floor polish removing performance has been achieved which is equal to and often exceeds the performance of ammoniated floor polish removers containing undesirable solvents.

In another aspect, the present invention provides a method of preparing the floor polish remover composition which, in liquid form, comprises the steps of mixing the alkalinity builder with the demineralized water, adding and mixing the amine with the mixed alkalinity builder and water, adding and mixing the hydrotrope to the mixture of alkalinity builder, amine and water, and then adding and mixing the nonionic surfactant into the mixture. In the dry form of the present invention, the method of preparing the floor polish remover includes the steps of adding a liquid amine to a dry carrier such that the amine and the carrier form a dry composition, adding a liquid nonionic surfactant to a dry carrier such that the nonionic surfactant and the carrier form a dry composition, and mixing the alkalinity builder, the dry amine/carrier composition and the dry nonionic/carrier composition.

The present invention further includes a method of using the floor polish remover composition of the present invention. In the liquid form, the method includes the step of mixing the liquid floor polish remover with water in a ratio, in parts per volume, of one part liquid floor polish remover to about one part to about fifty parts water. In the dry floor polish remover composition, the method of the present invention includes mixing one part of the dry composition with about two to about fifty parts water in parts per volume.

DETAILED DESCRIPTION OF THE PREFERRED EMBODIMENTS

The novel floor polish remover composition of this invention includes in its liquid form five ingredients. The first ingredient is a low molecular weight ethoxylated nonionic surfactant. The nonionic surfactants used herein are produced by the condensation of an alkylene oxide, preferably ethylene oxide, with an aliphatic alcohol. The aliphatic alcohol is a mixture of alcohols having a carbon chain of from about 4 carbon atoms to about 20 carbon atoms to produce a low molecular weight alcohol having an average of from about 5 to about 11 carbon atoms. Alternatively, the alcohol moiety may be a single alcohol within this $C_5$ to $C_{11}$ carbon atom range. That is, the alcohol moiety has an average of from about 5 to about 11 carbon atoms and includes one or more alcohols having a carbon chain length of from about $C_4$ to about $C_{20}$. The alcohol carbon chain may be straight or branched. Preferred alcohols for use herein in forming the nonionic surfactants of the present invention include n-butyl alcohol, n-pentyl alcohol, n-hexyl alcohol, n-heptyl alcohol, n-octyl alcohol, n-nonyl alcohol, n-decyl alcohol, n-undecyl alcohol, n-dodecyl alcohol and n-tetradecyl alcohol. Various branched low molecular weight alcohols having an average of from about 8 to about 11 carbon atoms may be suitable such as isooctyl alcohol and tert-nonyl alcohol.

The alkylene oxide component used in forming the low molecular weight nonionic surfactants for use in the present invention is, as stated, preferably ethylene oxide, although propylene oxide may be suitable in some applications. The quantity of ethylene oxide used in forming the low molecular weight nonionic surfactants of the present invention is from about 2 moles to about 8 moles and preferably from about 2 moles to about 6 moles of ethylene oxide per mole of alcohol. Particularly effective low molecular weight nonionic surfactants for use in the present invention are the condensation products bounded by the following four compounds, condensation products of 1 mole of an 8 carbon average alcohol and about 2 moles of ethylene oxide, 1 mole of an 8 carbon average alcohol with about 6 moles of ethylene oxide, one mole of an 11 carbon average alcohol with about 2 moles of ethylene oxide, and 1 mole of an 11 carbon average alcohol with about 6 moles of ethylene oxide. It has been found that the low molecular weight nonionic surfactants used in this invention provide unexpected and superior floor polish removing performance.

The low molecular weight nonionic surfactants comprise from about 0.1 percent to about 30.0 percent by weight, preferably from about 5.0 percent to about 15 percent by weight, and most preferably about 10.0 percent by weight of the liquid floor polish remover composition of the present invention. Although the liquid form of the present invention is preferred, a dry formulation is also provided. Low molecular weight nonionic surfactants comprise from about 1.0 to about 30.0 percent, and preferably from about 5.0 to about 15.0 percent by weight of the dry floor polish remover composition of the present invention.

The second component of the floor polish remover composition of the present invention is an alkalinity builder. Alkaline builders preferred for use in the present invention include alkali metal phosphates such as orthophosphates, pyrophosphates, tripolyphosphates, and hexametaphosphates, specific examples of which include tetrasodium monohydrogen tripolyphosphate, trisodium dihydrogen tripolyphosphate, sodium tripolyphosphate, tetrapotassium pyrophosphate, and potassium tripolyphosphate. It may be preferable in some applications of dry formulations to hydrate the phosphate compound and hydrated sodium tripolyphosphate is especially preferred for use herein. The alkaline builders used herein may include silicates, preferably alkali metal silicates such as sodium and potassium silicates. Sodium silicates which have a $SiO_2$:$Na_2O$ ratio of from 0.5:1 to 4:1 are preferred for use herein. Alkalinity builders preferred for use in the present invention also include alkali metal carbonates, borates, bicarbonates, and sulfates. Specific examples of which include the sodium and potassium tetraborates, perborates, bicarbonates and carbonates.

Stronger alkaline materials such as sodium or potassium hydroxide may be used as alkaline builders in the present invention. Citrates, such as sodium citrate, are useful as alkaline builders as are carboxymethyloxysuccinates and nitrilotriacetates. Ethylene diamine monoacetate, diacetates, triacetates and tetraacetates are also useful as alkalinity builders herein. The alkaline builders of the present invention may also include polymeric polyelectrolytes such as polyacrylates, polymaleates, polymethacrylates, polyacrylamides and copolymer of these compounds.

The alkalinity builder of the present invention comprises from about 0.1 percent to about 30.0 percent by weight and preferably from about 1.0 percent to about 10.0 percent by weight of the liquid floor polish remover composition of the present invention. The preferred alkaline builders comprise from about 1.0 percent to about 97.0 percent by weight and preferably from about 1.0 percent to about 10.0 percent by weight or higher if used as a carrier of the dry floor polish remover composition of the present invention. The alkalinity builders used in the present invention may be used alone or in combination with one another. Especially preferred for use herein are the phosphates, silicates, carbonates and borates. Of these, the silicates are most preferred for use herein. Hydrated sodium metasilicate has been found to be extremely desirable for use as the alkalinity builder of the present invention.

The third ingredient of the present invention is a hydrotrope. Hydrotropes preferred for use herein include etanolamines. Other hydrotropes preferred for use herein are the alkali metal salts of cumene, benzene sulfonates, xylene sulfonates, and toluene sulfonates. Alkali metal phosphonates, alkyl-substituted benzene sulfonates and disulfonates, fatty mono and dicarboxylic acids, such as 2-cyclohexene-1-octanoic acid, alkyl-substituted sulfosuccinates, and alkyl-substituted naphthalene sulfonates are also preferred hydrotropes for use in the present invention. Also suitable for use as hydrotropes in the present invention are alkyl and alkylaryl phosphate esters. Also, amphoteric surfactants such as glycinates, propionates and betaines are useful herein.

The preferred hydrotropes may be used herein alone or in combination with each other and comprise up to about 30.0 percent by weight, preferably from about 0.1 to 10.0 percent by weight and most preferably from about 2.0 to 8.0 percent by weight of the liquid floor polish remover composition of the present invention.

The fourth ingredient of the present invention is an amine. It may be possible in some applications to increase the concentration of the alkalinity builders in the present composition and decrease or eliminate the amine component. Suitable amines for use in the present invention include but are not limited to monoethanolamine, diethanolamine, triethanolamine, monoisopropanolamine, diisopropanolamine, triisopropanolamine, 2-amino-2-methyl-1-propanol, 2-aminoethylethanolamine, 2-amino-1-butanol, 2-amino-2-methyl-1-propanol, 2-amino-2-methyl-1,3-propandiol, tris(hydroxymethyl)-aminomethane, 2-amino-1-butanol, 2-amino-2-methyl-1-propanol,2-dimethylamino-2-methyl-1-propanol, diethylethanolamine, ethyl monethanolamine, ethyl diethanolamine, morpholine, n-methyl morpholine, n-ethyl morpholine, ethylamine, diethylamine, triethylamine. Particularly preferred is monoethanolamine. Ammonia is also suitable.

The amine component of the present invention comprises from about 0.1 percent to about 30.0 percent by weight and preferably about 5 percent by weight of the liquid floor polish remover of the present invention. In the dry floor polish remover composition of the present invention, an amine comprises from about 0.1 percent to about 30.0 percent by weight of the composition. It is to be understood that a single amine or a combination of the preferred amines may be used as the amine component of the present invention.

The fifth ingredient of the present invention, in the liquid composition, is substantially deionized or demineralized water. Demineralized water comprises from about 1.0 percent by weight to about 99.0 percent of the floor polish remover by weight and preferably from about 70.0 percent to 96.0 percent by weight of the composition. The degree of hardness of the water as grains of calcium carbonate per gallon of water should preferably but need not be less than about 5 grains per gallon. In dry formulations, a suitable carrier would be substituted for water. Suitable carriers would include but are not limited to alkali metal salts of phosphates, sulfates, carbonates and borates.

The present invention also includes a method of preparing the floor polish remover of the present invention which, in its liquid form, comprises the steps of mixing in a container the alkalinity builder with the demineralized water, adding and mixing the amine with the mixed alkalinity builder and water, adding and mixing the hydrotrope to the mixture of alkalinity builder, amine and water, and adding and mixing the nonionic surfactant into the mixture. In the dry form of the present invention, the method of preparing the floor polish remover includes the steps of adding a liquid amine to a dry carrier such that the amine and the carrier form a dry composition, adding the nonionic surfactant to a dry carrier such that the nonionic surfactant and the carrier form a dry composition, and mixing the alkalinity builder, the dry amine/carrier composition and the dry nonionic/carrier composition together to form the final dry floor polish remover composition. The preferred dry carrier is a phosphate compound such as sodium tripolyphosphate or a carbonate such as sodium carbonate although other suitable carriers such as sodium sulfate will be known to those skilled in the art.

The present invention further includes a method of using the floor polish remover composition which includes, in the liquid form, the step of mixing the liquid floor polish remover with water in a ratio in parts per volume of one part liquid floor polish remover with about one part to about fifty parts water and most preferably about five parts water. In the dry floor polish remover composition, the method of the present invention includes mixing one part of the dry composition with about two to about fifty parts water by volume.

A further understanding of the present invention will be obtained from the following specific examples which are intended to illustrate the invention but not to limit the scope thereof, parts and percentages being by weight unless otherwise indicated.

EXAMPLES

The following floor polish remover performance tests were conducted using various low molecular weight nonionic surfactants which were the products of short-chain aliphatic alcohols condensed with ethylene oxide. The floor polish remover compositions tested had the following formulations. Percentages are by weight unless otherwise indicated:

10%: Nonionic Surfactant
5%: Monethanolamine
5%: Sodium Meta Silicate.$5H_2O$
5%: Hydrotrope (2-cyclohexane-1-octanoic acid)
75%: Soft Water For each test, a single coat of a detergent-resistant floor polish was applied to a floor tile. The polish was then air-dried and aged twenty-four hours. In order to obtain a reference standard, the above formulation was prepared using Alfonic 610-50R as the nonionic surfactant. Alfonic 610-50R is a nonionic surfactant prepared by the condensation of aliphatic alcohols having from 6 to 10 carbons with an average of 50 percent by weight or an average of 3.3 moles of ethylene oxide. This formulation was diluted one part floor polish remover to five parts water and the diluted floor polish remover was then applied to the polished floor surface and its effectiveness in removing the dried polish determined using a Gardiner scrubability machine. Effectiveness was evaluated visually by a panel of evaluators. This test is a modification of ASTM test procedure D-1792-

82. The observation was then divided into the results of the remaining tests and multiplied by 100 to express results as percent of the reference standard. Those test formulations which were less effective in removing the sample floor polish remover than the Alfonic 610-50R formulations are expressed as percentages less than 100%. Those test formulations which were more effective in removing the sample floor polish remover than the Alfonic 610-50R formulation are expressed as percentages greater than 100%.

| Test No. | Trademark | Supplier | Average Carbon Chain Length | Average Moles EO | Relative Performance (%) |
|---|---|---|---|---|---|
| 1 | ALFONIC 610-50R | Vista Chemical Company | 8.7 | 3.3 | 100 |
| 2 | NONANOL 2EO | Shell Chemical Company | 9 | 2 | 96 |
| 3 | NONANOL 3EO | Shell Chemical Company | 9 | 3 | 103 |
| 4 | NONANOL 6EO | Shell Chemical Company | 9 | 6 | 97 |
| 5 | NEODOL 91-2.5 | Shell Chemical Company | 10.1 | 2.5 | 107 |
| 6 | NEODOL 91-6 | Shell Chemical Company | 10.1 | 6 | 85 |
| 7 | ALFONIC 810-50 | Vista Chemical Company | 9.1 | 3 | 109 |
| 8 | ALFONIC 810-60 | Vista Chemical Company | 9.1 | 4.9 | 106 |
| 9 | ALFONIC 610-60 | Vista Chemical Compnay | 8.7 | 4.5 | 85 |
| 10 | MACOL 212 | Mazer Chemicals, Inc. | 6 | 3 | 74 |
| 11 | HEXYL CELLOSOLVE | Union Carbide Corp. | 6 | 1 | 91 |
| 12 | ETHANOL | Commodity | 2 | 0 | 24 |
| 13 | BUTYL CELLOSOLVE | Union Carbide Corp. | 4 | 1 | 36 |
| 14 | DOWANOL DB | Dow Chemical | 4 | 2 | 53 |
| 15 | MACOL 229-16 | Mazer Chemicals, Inc. | 4.6 | 4.5 | 41 |
| 16 | ALFOL 810 | Vista Chemical Company | 9.1 | 0 | 21 |
| 17 | NONANOL 9EO | Shell Chemical Company | 9 | 12 | 67 |
| 18 | NEODOL 25-3 | Shell Chemical Company | 13.2 | 3 | 46 |
| 19 | NEODOL 25-7 | Shell Chemical Company | 13.2 | 7.2 | 43 |
| 20 | NEODOL 25-12 | Shell Chemical Comapny | 13.2 | 12 | 56 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A liquid floor polish remover composition consisting of:

from about 0.1 percent to about 30 percent by weight of a nonionic surfactant, said surfactant being selected from the group of nonionic surfactants which are the condensation products of an alcohol component having an average of from about 5 to about 11 carbon atoms condensed with from about 2 to about 8 moles of an alkylene oxide per mole of said alcohol; from about 0.1 percent to about 30 percent by weight of an alkalinity builder; up to about 30 percent by weight of a hydrotrope; from about 0.1 to about 30 percent by weight of an amine; and from about 1 percent to about 99 percent substantially demineralized water, wherein said alkalinity builder is selected from the group consisting of alkali metal phosphates, alkali metal silicates, alkali metal carbonates, alkali metal borates, alkali metal bicarbonates, and combinations thereof.

2. The floor polish remover composition recited in claim 1, wherein said alcohol component is composed of $C_4$ to $C_{20}$ alcohols selected from the group consisting of n-butyl alcohol, n-pentyl alcohol, n-hexyl alcohol, n-heptyl alcohol, n-octyl alcohol, n-nonyl alcohol, n-decyl alcohol, n-undecyl alcohol, n-dodecyl alcohol, n-tetradecyl alcohol, isopentyl alcohol, tert-pentyl alcohol and combinations thereof.

3. The floor polish remover composition recited in claim 1, wherein said alkylene oxide is selected from the group consisting of ethylene oxide and propylene oxide.

4. The floor polish remover composition recited in claim 1, wherein said hydrotrope is selected from the group consisting of alkali metal salts of cumene, benzene sulfonates, xylene sulfonates, toluene sulfonates, alkali metal phosphonates, alkyl-substituted benzene sulfonates, alkyl-substituted disulfonates, fatty monocarboxylic acids, fatty di-carboxylic acids, 2-cyclohexene-1-octanoic acid, alkyl phosphate esters, alkylaryl phosphate esters, and amphoteric surfactants.

5. The floor polish remover composition recited in claim 1, wherein said amine is selected from the group consisting of monoethanolamine, diethanolamine, triethanolamine, monoisopropanolamine, diisopropanolamine, triisopropanolamine, 2-amino-2-methyl-1-propanol, 2-aminoethylethanolamine, 2-amino-1-butanol, 2-amino-2-methyl-1-propanol, 2-amino-2-methyl-1,3-propandiol, tris(hydroxymethyl)aminomethane, 2-amino-1-butanol, 2-amino-2-methyl-1-propanol, 2-dimethylamino-2-methyl-1-propanol, diethylethanolamine, ethyl monethanolamine, ethyl diethanolamine, morpholine, n-methyl morpholine, n-ethyl morpholine, ethylamine, diethylamine, triethylamine and combinations thereof.

6. A method of removing floor polish, comprising the steps of:

adding one part of a composition consisting of about 0.1 percent to about 30 percent by weight of a nonionic surfactant, said surfactant being selected from the group of nonionic surfactants which are the condensation products of an alcohol having an average of from about 5 to about 11 carbon atoms condensed with from about 2 to about 8 moles of a alkylene oxide per mole of said alcohol; from about 0.1 percent to about 30 percent by weight of an alkalinity builder; up to about 30 percent by weight of a hydrotrope; from about 0.1 to about 30 percent by weight of an amine; and from about 0.1 percent to about 99 percent by weight substantially demineralized water to from about one part to about 50 parts water;

mixing said one part of said composition with said one to about 50 parts water to form a floor polish remover solution;

applying said floor polish remover solution to the surface of a floor, said floor surface having a layer of floor polish thereon;

allowing said floor polish remover solution to remain on said floor to dissolve and soften said floor polish such that it can be removed with mechanical action; and removing said dissolved or floor polish and said floor polish remover solution from said floor, wherein said alkalinity builder is selected from the group consisting of alkali metal phosphates, alkali metal silicates, alkali metal carbonates, alkali metal borates, alkali metal bicarbonates, and combinations thereof.

7. The method recited in claim 6, wherein said alcohol component is composed of $C_4$ to $C_{20}$ alcohols.

8. The method of recited in claim 6, wherein said alkylene oxide is selected from the group consisting of ethylene oxide and propylene oxide.

9. The method recited in claim 6, wherein said hydrotrope is selected from the group consisting of alkali metal salts of cumene, benzene sulfonates, xylene sulfonates, toluene sulfonates, alkali metal phosphonates, alkyl-substituted benzene sulfonates, alkyl-substituted disulfonates, fatty mono-carboxylic acids, fatty dicarboxylic acids, 2-cyclohexene-1-octanoic acid, alkyl phosphate esters, alkylaryl phosphate esters, and amphoteric surfactants.

10. The method recited in claim 6, wherein said amine is selected from the group consisting of monoethanolamine, diethanolamine, triethanolamine, monoisopropanolamine, diisopropanolamine, triisopropanolamine, 2-amino-2-methyl-1-propanol, 2-aminoethylethanolamine, 2-amino-1-butanol, 2-amino-2-methyl-1-propanol, 2-amino-2-methyl-1,3-propandiol, tris(hydroxymethyl)-aminomethane, 2-amino-1-butanol, 2-amino-2-methyl-1-propanol, 2-dimethylamino-2-methyl-1-propanol, diethylethanolamine, ethyl monethanolamine, ethyl diethanolamine, morpholine, n-methyl morpholine, n-ethyl morpholine, ethylamine, diethylamine, triethylamine and combinations thereof.

* * * * *